United States Patent [19]

Lenox et al.

[11] 4,415,332

[45] Nov. 15, 1983

[54] DEVELOPMENT OF COLOR IN A POLYAMIDE TEXTILE MATERIAL WITH AMINOBENZENESULFONYL AZIDES

[75] Inventors: Ronald S. Lenox; Charles E. Hoyle, both of Lancaster, Pa.

[73] Assignee: Armstrong World Industries, Inc., Lancaster, Pa.

[21] Appl. No.: 429,333

[22] Filed: Sep. 30, 1982

[51] Int. Cl.[3] ..... D06P 5/20

[52] U.S. Cl. ..... 8/444; 8/666; 8/694; 8/924; 8/929

[58] Field of Search ..... 8/444, 666, 694

[56] References Cited

U.S. PATENT DOCUMENTS 4,322,211 3/1982 Hoyle et al. ..... 8/402

*Primary Examiner*—A. Lionel Clingman

[57] ABSTRACT

The present invention discloses a method of photolytically developing color on a polyamide textile material. The material is first contacted with an aminobenzenesulfonyl azide and then is exposed to a UV light source for an amount of time sufficient to develop a color thereon.

8 Claims, No Drawings

DEVELOPMENT OF COLOR IN A POLYAMIDE TEXTILE MATERIAL WITH AMINOBENZENESULFONYL AZIDES

DESCRIPTION OF THE INVENTION

The invention contemplates a method of photolytically developing color on a polyamide textile material. The method of the invention comprises first pretreating the material by contacting it with an aminobenzenesulfonyl azide of the Formula

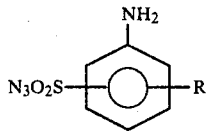

wherein, in the formula, R is H, a $C_1$–$C_4$ alkoxy group or a $C_1$–$C_4$ alkyl group. After this pretreatment step, the material is then exposed to a UV light source, whereupon a color photolytically develops on the material.

The term $C_1$–$C_4$ alkyl is used herein to indicate an unsubstituted straight or branched chain alkyl group having from 1 to 4 carbon atoms. The term $C_1$–$C_4$ alkoxy is used herein to indicate an unsubstituted straight or branched chain alkoxy group having from 1 to 4 carbon atoms.

Aminobenzenesulfonyl azides according to the Formula above may be reacted with any mineral acid to form a salt that will be suitable for use in the method of the present invention. Examples of suitable mineral acids include HBr, $H_2SO_4$ and $H_3PO_4$. HCl is the mineral salt of choice because it provides for very easy synthesis of the stable salt.

For example, hydrochloric salts which are suitable for use in the method of the present invention are prepared by treating methylene chloride solutions of the free aminobenzenesulfonyl azides with gaseous HCl. The synthesis of the aminobenzenesulfonyl azides is known (see T. Curtis, W. Stoll, *J. Prakt Chem*, 112, 1117 (1926) and British Intelligence Objective Sub-Committee, Final Report 1149, p. 24) and is quite straightforward, i.e., via the chlorosulfonation of the corresponding acetylated amines followed by condensation of the resulting sulfonyl chloride with sodium azide.

The term aminobenzene azide is used herein to indicate such an azide or its mineral acid salt. The azide (or its salt) may be contacted with the polyamide material either neat or in solution.

The polyamide textile materials which may be photolytically colored according to the process of the present invention comprise fabrics, fibers, filaments, yarns, pellicls, flocks and the like which are produced from a linear polyamide containing recurring units of the formula:

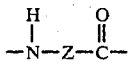

wherein Z is a member of the class consisting of a divalent hydrocarbon radical containing from 1 to about 20 carbon atoms and a divalent radical of the formula:

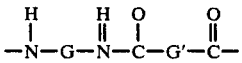

wherein G and G′ are divalent hydrocarbon radicals independently containing from 1 to about 20 carbon atoms. Particularly suitable textile materials include nylon polymers such as nylon 66, a condensation product of adipic acid and hexamethylenediamine; nylon 6, a polymer of caprolactam; nylon 4, which is based on butyrolactam (2-pyrolidone); and nylon 610, which is obtained by condensation of sebacic acid and hexamethylenediamine.

The polyamide material may be contacted with the aminobenzenesulfonyl azide, its salt, or preferably a solution of either in any manner that is convenient to the individual practitioner of the invention. For example, the material may be completely or partially immersed in a solution containing the azide or its salt or such a solution may be sprayed or brushed on the masterial. The solution may be applied to all or a portion of the material, in the latter case the solution may be applied so as to produce a decorative pattern on the material.

After being contacted with an azide solution, the material may optionally be water washed and, if desired, dried. The material is then exposed to a UV light source for an amount of time sufficient to develop a color on the material.

Since this technique does not interfere with the ability of the polyamide material to be dyed using conventional techniques, a photolytically dyed polyamide material according to this invention, such as a carpet, can then be overdyed with conventional dyes, if desired.

Aqueous solutions of the azide salts should be maintained at an acidic pH, i.e. no more than 7. Lower pH's i.e. below about 2, are preferred since the aminobenzene-sulfonyl azide salt dissolves more readily in water at such lower pH's. Most preferably, the pH of the solution will be below 1. Basic pH's are not suitable for the solution, as sulfonyl azides will rapidly decompose in a basic solution. Any mineral acid may be utilized to maintain the solution at an acidic pH. The term "mineral acid" is used herein to describe acids which do not dissociate to form an organic residue. Examples of suitable acids include hydrochloric acid, nitric acid, sulfuric acid, phosphoric acid and phosphorous acid.

It is understood that the practitioner of this invention can vary the color developed by varying selected factors such as the amount of azide used, the concentration of the azide or its salt in solution, the treatment contact time, the temperature of the solution, the specific azide or its salt being used and/or the UV exposure time.

If an azide (or salt) solution is utilized, the temperature of such a solution is not an important parameter of this invention. Indeed, any temperature at which the solution remains in a liquid state is suitable for the purposes of this invention. However, with all other factors being identical, it has been discovered that higher solution temperatures will produce darker colors on the polyamide materials than lower solution temperature. Best results are obtained if the solution is above 60° C.

An azide solution will preferably contain from about 0.001 to about 10 g of the azide or its salt per 100 ml of water. At lower concentrations, the polyamide material will have to be treated for longer periods of time in order to obtain a noticeable color change. Theoretically, concentrations of the azide or its salt lower than 0.001g/100 ml water may be utilized to achieve a coloration effect. However, at such low concentrations, the material may have to be treated for very long periods of time.

The upper concentration of the azide or its salts is only limited to the amount of azide or its salts that can be put into solution. Normally, more of the azide can be put into solution as the temperature of the solution increases or if the solution is put under pressure. With all other factors being identical, it has been discovered that higher azide (or salt) concentrations in the solution will produce darker colors on the polyamide material than lower azide concentrations.

The amount of UV light exposure time needed to develop color on the polyamide material is dependent on parameters such as the intensity of the light source, the distance of the UV light source from the material, the amount of the azide used or the concentration of the azide or its salt in solution, the temperature of such solutions and/or the amount of time the material was contacted with the solution. One can, by increasing any of these parameters except the distance of the UV light source from the material, lessen the amount of light exposure time needed to develop a color on the polyamide material.

Any UV light source is suitable for photolytically developing color on the treated material, although light sources with both visible and ultraviolet output are preferred. Examples of suitable light sources include Xenon lamps and mercury lamps. The treated sample will also develop color in the presence of sunlight alone, although the exposure time needed to develop such a color is considerably longer in sunlight than with standard UV light emitting lamps.

The polyamide textile materials treated according to the process of the present invention may first, prior to such pretreatment steps, be scoured, such as by being solvent and water washed at high temperatures, to thereby remove fiber dressing and spinning aids. This scouring and subsequent drying step is considered to be optional, and not essential, to the process of the present invention.

EXAMPLE 1

Preparation of 4-aminobenzenesulfonyl azide hydrochloride:

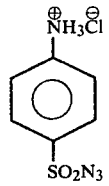

Ten grams of 4-aminobenzenesulfonyl azide was dissolved in 0.4 liters of dry methylene chloride and gaseous HCl was bubbled through the solution for 10 minutes. The insoluble salt which formed was collected by suction filtration and placed under vacuum for several hours to remove excess HCl. The product compound was formed quantitatively (11.8 g) as a white solid, which decomposed at 175°–178° C. with the evolution of gas. NMR spectra, obtained on a JEOL-H-100 Spectrometer, and IR spectra, determined on a Perkin Elmer 457 instrument, revealed the following values which are consistant with the assigned structure:

NMR (DMSO-$d_6$): 6.94 (d,2H), 7.71 (d,2H), 8.79 (s,3H, —$NH_3$).

IR (KBr): 2280 (s), 2130 (s), 1591 (m), 1489 (s), 1365 (s), 1160 (s), 1084 (s), 819 (s), 748 $cm^{-1}$ (s).

EXAMPLE 2

Preparation of 1-amino-2-methoxy-5-benzenesulfonyl azide hydrochloride:

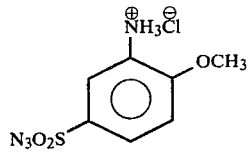

Ten grams of 3-amino-4-methoxybenzenesulfonyl azide was dissolved in 0.4 liters of dry $CH_2Cl_2$. Dry HCl gas was bubbled through the solution for 10 minutes. The resulting solid was collected and was stored under vacuum for several hours to remove excess HCl. 11.6 g of the product compound was recovered as a white solid, mp. from 184°–186° C. was observed with the evolution of gas. NMR and IR spectra revealed the following values which are consistent with the assigned structures:

NMR (DMSO-$d_6$): 3.98 (s,3H), 7.30–7.98 (m,3H), 9.47 (s,3H, —$NH_3$).

IR (KBr): 2850 (s), 2580 (s), 2058 (s), 1621 (m), 1500 (s), 1378 (s), 1279 (s), 758 (s), 608 $cm^{-1}$ (s).

EXAMPLES 3–6

Four 1 gram samples of Nylon 66 yarn were treated as follows: 40 ml of deionized water and 10 ml of solution A (set forth below) were placed in each of four separate 100 ml beakers. The liquid in each beaker was then brought to a boil. A yarn sample was then inserted into each beaker for15 minutes at 100° C. The yarn was then removed, blotted on filter paper and air-dried overnight. The yarn was then photolyzed under the conditions set forth in the Table. In each instance, a tannish-yellow (heather) color developed on the yarn.

TABLE

| Yarn Sample | UV Source | Exposure Time (min) | Distance from UV Source (inches) |
|---|---|---|---|
| 1 | mercury lamp | 5 | 3 |
| 2 | mercury lamp | 5 | 3 |
| 3 | Xenon lamp | 5 | 12 |
| 4 | Xenon lamp | 5 | 12 |

Solution A: 2.5 g of the compound of Example 1 in sufficient 1.0M HCl to make 100 ml of solution.

The color which developed on the yarn was found not to be extractable after 10 minutes immersion in boiling water.

EXAMPLE 7

A 6"×6" piece of cut pile Nylon 66 greige goods was treated for 10 minutes in a 100° C. solution comprised of 2 g of the product compound of Example 1, 50 ml of 1M HCl and 100 ml of deionized water. After the greige goods were rinsed and dried, they were photolyzed under a Xenon lamp for one minute. A brownish color developed which was not extractable after being immersed for 10 minutes in boiling water.

What is claimed is:

1. A method of photolytically developing color on a polyamide material, which comprises treating the material by contacting it with an aminobenzenesulfonyl azide of the formula

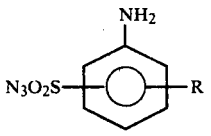

wherein R is H, A $C_1$–$C_4$ alkoxy group or a $C_1$–$C_4$ alkyl group, or a salt thereof, and exposing the treated material to a UV light source to thereby develop color on the material.

2. The method of claim 1 wherein the aminobenzenesulfonyl azide or its salt is in solution.

3. The method of claim 1 wherein the solution contains from 0.001 to 10 grams of the azide or its salt per 100 ml of solvent.

4. The method of claim 1 wherein the material is contacted with an aqueous solution of the aminobenzenesulfonyl salt.

5. The method of claim 1 wherein the pH of the solution is less than about 2.

6. The method of claim 1 wherein the material is contacted with aminobenzenesulfonyl hydrochloride salt.

7. The method of claim 5 wherein R represents H.

8. The method of claim 5 wherein R represents $OCH_3$.

* * * * *